US008357004B2

(12) United States Patent
Tao et al.

(10) Patent No.: US 8,357,004 B2
(45) Date of Patent: Jan. 22, 2013

(54) CONNECTOR ASSEMBLY

(75) Inventors: Heng Tao, Wuhan (CN); Biao Zeng, Wuhan (CN); Zhi-Guo Zhang, Wuhan (CN); Li-Fu Xu, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/241,235

(22) Filed: Sep. 23, 2011

(65) Prior Publication Data

US 2012/0156918 A1 Jun. 21, 2012

(30) Foreign Application Priority Data

Dec. 20, 2010 (CN) ..... 2010 1 0596699

(51) Int. Cl.
*H01R 13/62* (2006.01)

(52) U.S. Cl. ..... 439/352

(58) Field of Classification Search ..... 439/680, 439/681, 352, 357, 358, 351, 353, 350
See application file for complete search history.

(56) References Cited

U.S. PATENT DOCUMENTS

| | | | | |
|---|---|---|---|---|
| 4,993,803 | A * | 2/1991 | Suverison et al. | 385/88 |
| 5,342,221 | A * | 8/1994 | Peterson | 439/677 |
| 5,378,168 | A * | 1/1995 | Sumida | 439/358 |
| 5,628,648 | A * | 5/1997 | Higgins et al. | 439/489 |
| 6,022,246 | A * | 2/2000 | Ko | 439/680 |
| 6,206,717 | B1 * | 3/2001 | Matsumoto | 439/354 |
| 6,364,718 | B1 * | 4/2002 | Polgar et al. | 439/680 |
| 6,592,392 | B2 * | 7/2003 | Po-Heng | 439/358 |
| 6,860,765 | B1 * | 3/2005 | Spink, Jr. | 439/680 |
| 6,863,444 | B2 * | 3/2005 | Anderson et al. | 385/53 |
| 7,144,268 | B2 * | 12/2006 | Koenig et al. | 439/353 |
| 7,682,181 | B1 * | 3/2010 | Jones et al. | 439/352 |
| 7,731,519 | B1 * | 6/2010 | Swenson, Jr. | 439/352 |
| 7,753,718 | B2 * | 7/2010 | Bethurum et al. | 439/441 |
| 8,043,106 | B1 * | 10/2011 | Morello et al. | 439/352 |

* cited by examiner

*Primary Examiner* — Alexander Gilman
(74) *Attorney, Agent, or Firm* — Altis Law Group, Inc.

(57) ABSTRACT

A connector assembly includes a first connector with a positioning portion and a second connector with a latch. A blocking portion is located on a second side of the first connector. The latch defines an oblique latching plane, the positioning portion defines an oblique sliding plane, and the blocking portion defines an oblique blocking plane. If the latch is aligned with the positioning portion and is slid towards the first connector, the oblique direction of the second latching plane is substantially the same as the oblique positioning plane. If the latch is aligned with the blocking portion and is slid towards the first connector, an acute angle is defined between the oblique direction of the second latching plane and the oblique direction of the blocking plane.

15 Claims, 6 Drawing Sheets

CONNECTOR ASSEMBLY

REARGROUND

1. Technical Field

The present disclosure relates to connector assemblies, and particularly to a connector assembly with a foolproof mechanism.

2. Description of Related Art

A connector assembly is used for transmitting data between two electronic devices. The connector assembly includes a first connector with a plurality of inserting slots and a second connector with a plurality of plugs. Each plug must be inserted into a corresponding inserting slot, before the connector assembly can work normally. However, it is easy to insert a plug into a wrong inserting slot. Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
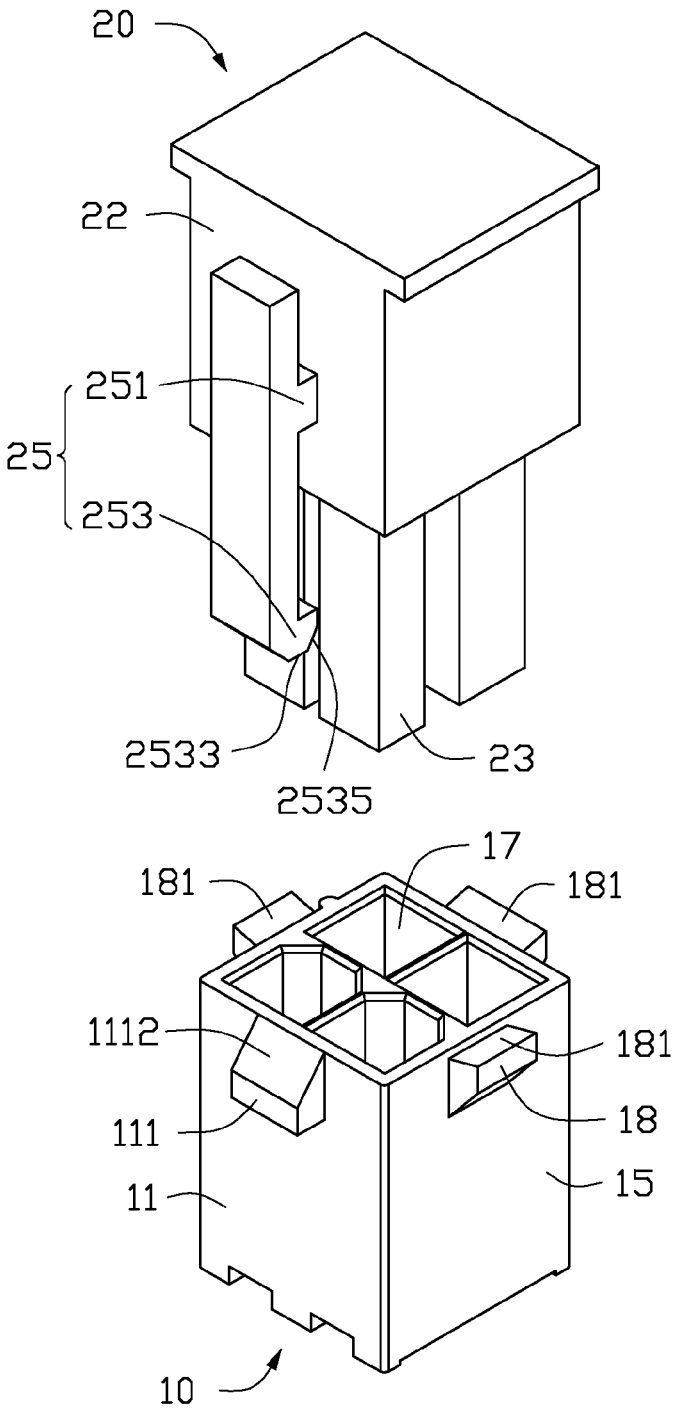
FIG. 1 is an exploded, isometric view of a connector assembly in accordance with one embodiment.
Figure 2:
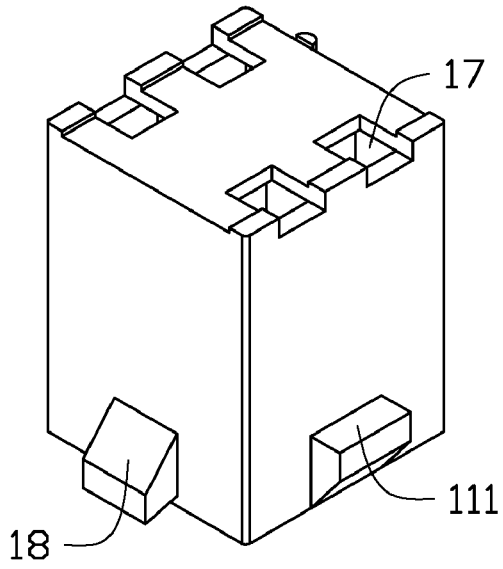
FIG. 2 is similar to FIG. 1, but viewed from another angle.
Figure 2:
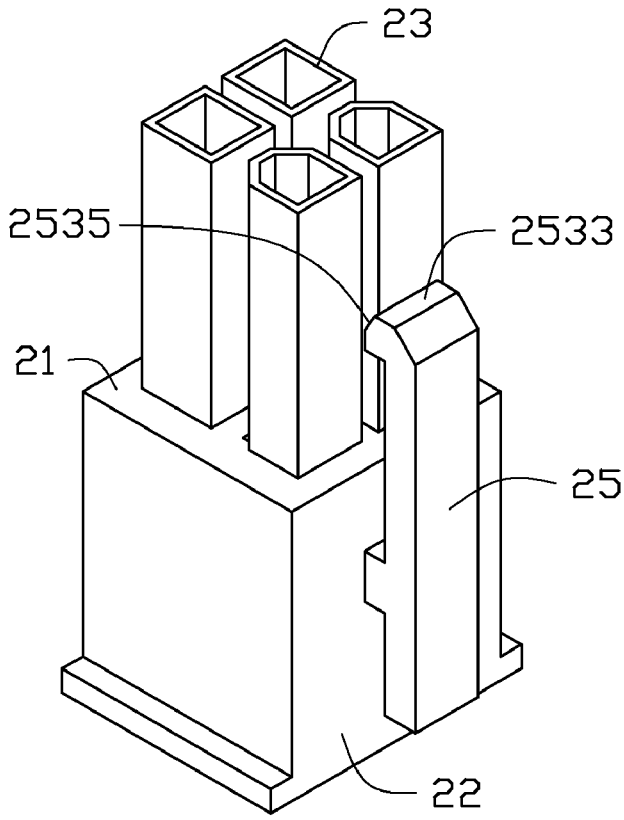

Referring to FIG. 1 and FIG. 2, a connector assembly includes a first connector 10 and a second connector 20.

The first connector 10 includes a front plate 11 and three side plates 15. The first connector 10 defines a plurality of inserting slots 17. The meeting end is where one end of the first connector 10 meets an end of the second connector 20. A positioning portion 111 extends from the front plate 11 and includes a sliding plane 1112. The sliding plane 1112 extends downwards from the meeting end and rises from the front plate 11. The angle between the sliding plane 1112 and the front plate 12, is acute. A blocking portion 18 extends from each side plate 15, and each portion 18 is adjacent to the meeting end. The blocking portion 18 includes a blocking plane 181, and from a point which is coplanar with the meeting end, the plane of the blocking plane 181 is tilted down towards the longitudinal center of the first connector 10. The angle defined between the blocking plane 181 and the side plate 15 is acute.

The second connector 20 includes a bottom wall 21, a sidewall 22, a plurality of pins 23, and a latch 25. The bottom wall 21 is substantially perpendicular to the sidewall 22. The pins 23 are secured to the bottom wall 21. Each pin 23 corresponds to each inserting slot 17. The latch 25 is located out of the bottom wall 21 and extends to the pins 23. The latch 25 extends from the sidewall 22 and includes a maintaining portion 251 and a latching portion 253 connected to the maintaining portion 251. The maintaining portion 251 is connected to the sidewall 22. The latching portion 253 includes a first latching plane 2533 and a second latching plane 2535. The first latching plane 2533 is substantially perpendicular to the sidewall 22. The second latching plane 2535 is oblique, the angle defined between the first latching plane 2533 and the second latching plane 2535 is obtuse, and the second latching plane 2535 is on an inner surface of the latch 25 at the distal end thereof.

Figure 3:
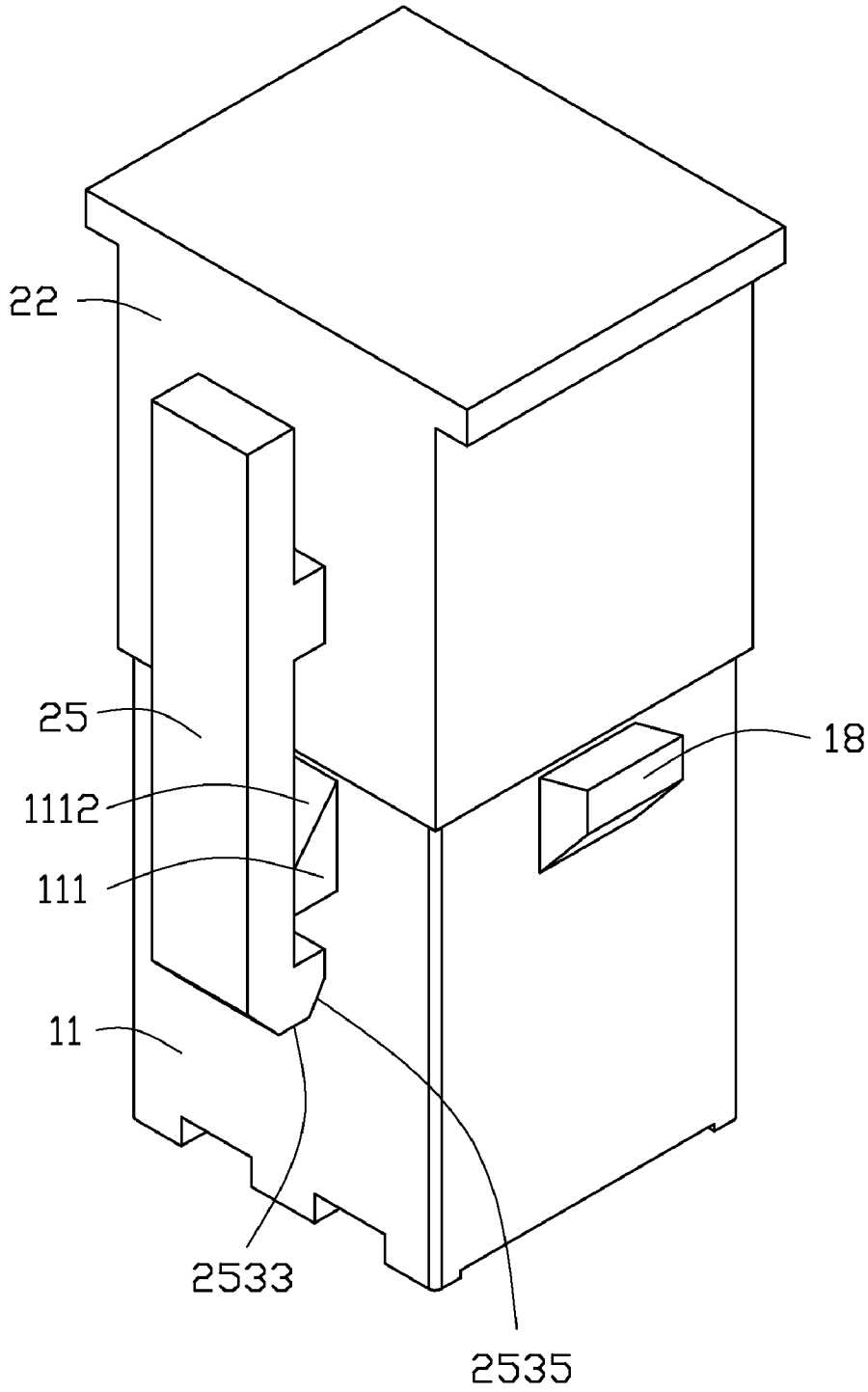
FIG. 3 is an isometric view of the assembled connector assembly of FIG. 1 when the connector assembly is correctly assembled.
Figure 4:
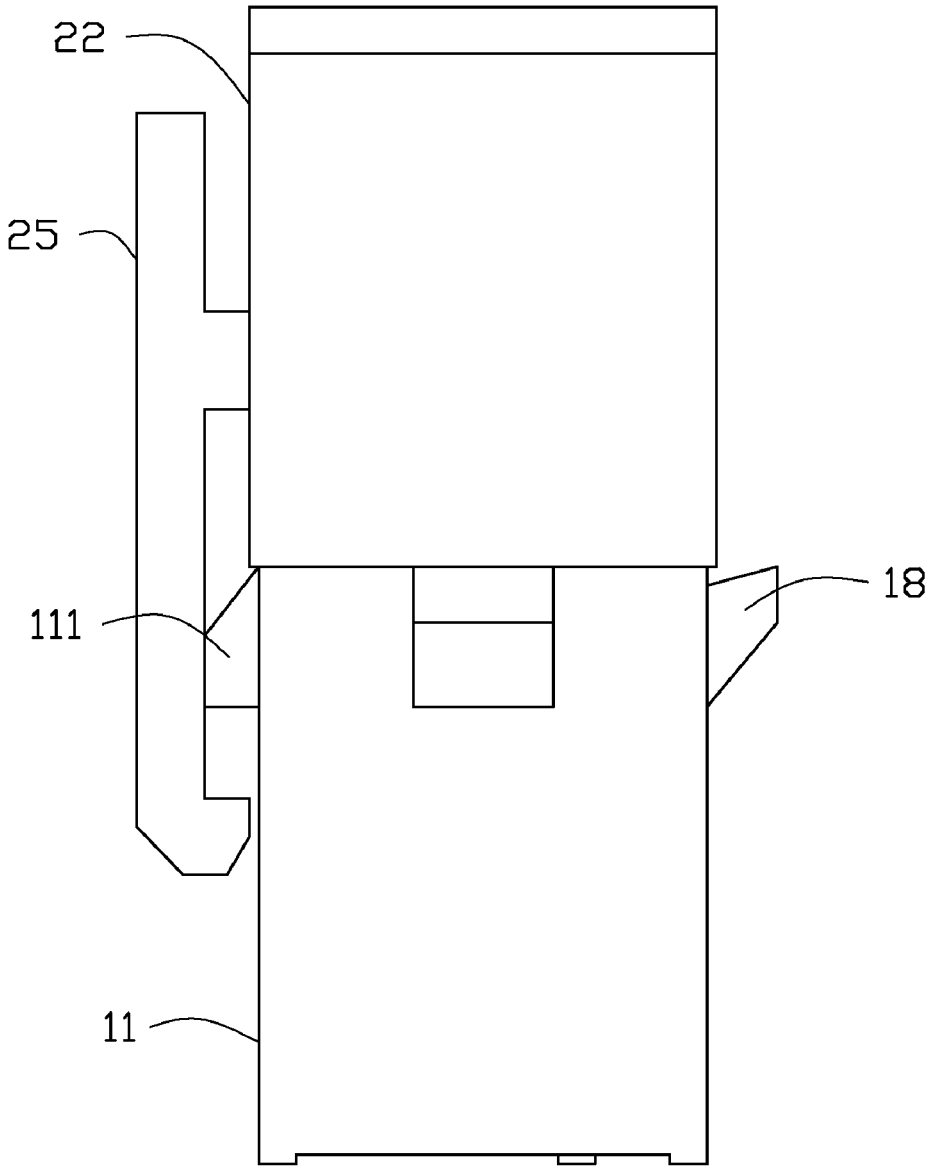
FIG. 4 is a side view of the correctly assembled connector assembly of FIG. 3.

Referring to FIGS. 3 and 4, the second connector 20 is moved towards the first connector 10. The latch 25 is aligned with the positioning portion 111. The second connector 20 is pushed towards the first connector 10 until the first latching plane 2533 abuts the sliding plane 1112. The pins 23 are inserted into the inserting slots 17. The second connector 20 is further pushed to elastically deform the latch 25. The second latching plane 2535 then abuts the sliding plane 1112. The latch 25 is slid downwards along the sliding plane 1112 until the latching portion 253 has slid over the positioning portion 111. Each pin 23 is then fully inserted into the correct corresponding slot 17.

In disassembly, the latch 25 is pulled out from the first connector 10, and the second connector can be withdrawn.

Figure 5:
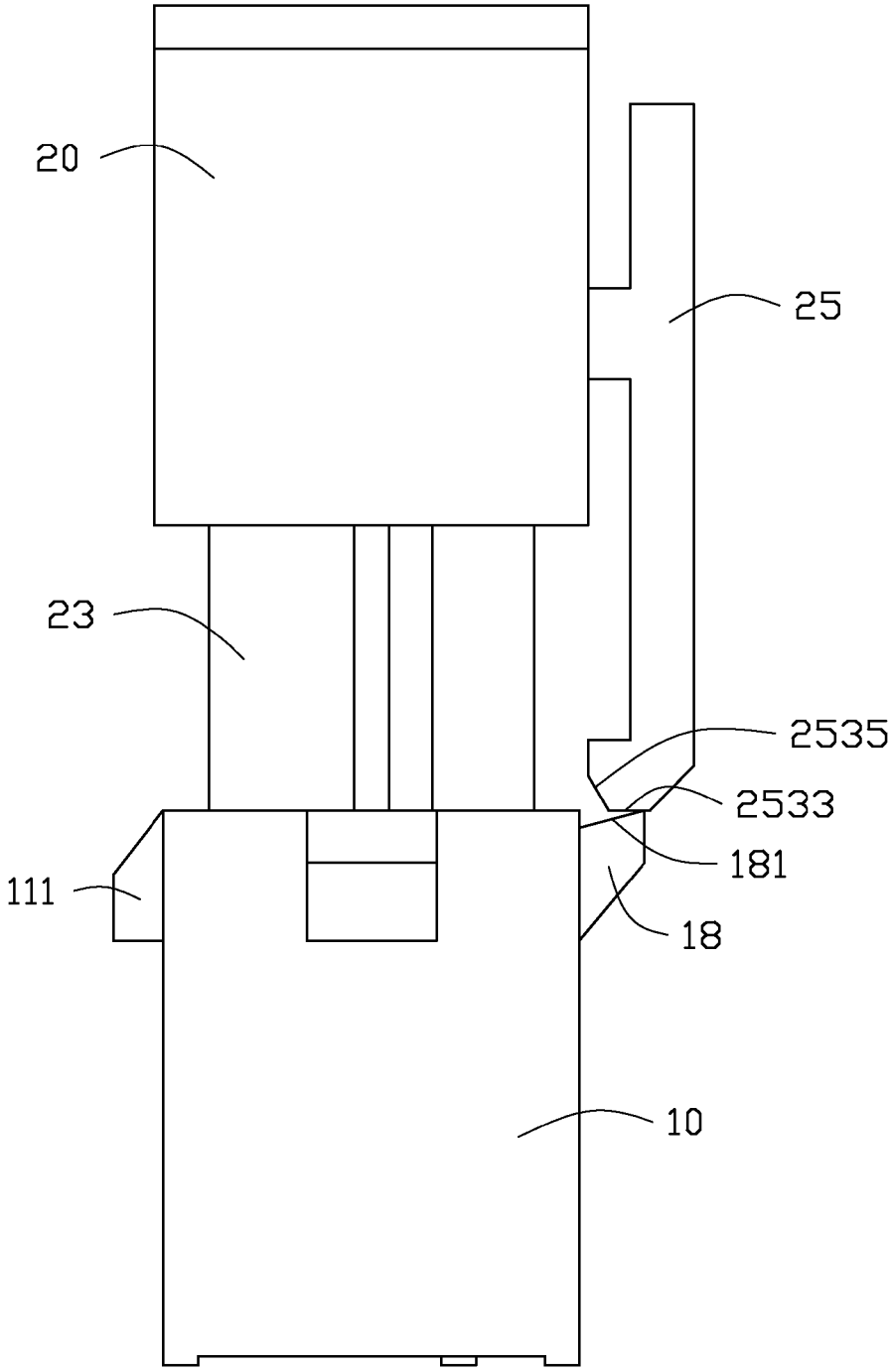
FIG. 5 is a side view of the assembled connector assembly of FIG. 1 when the connector assembly is incorrectly assembled.
Figure 6:
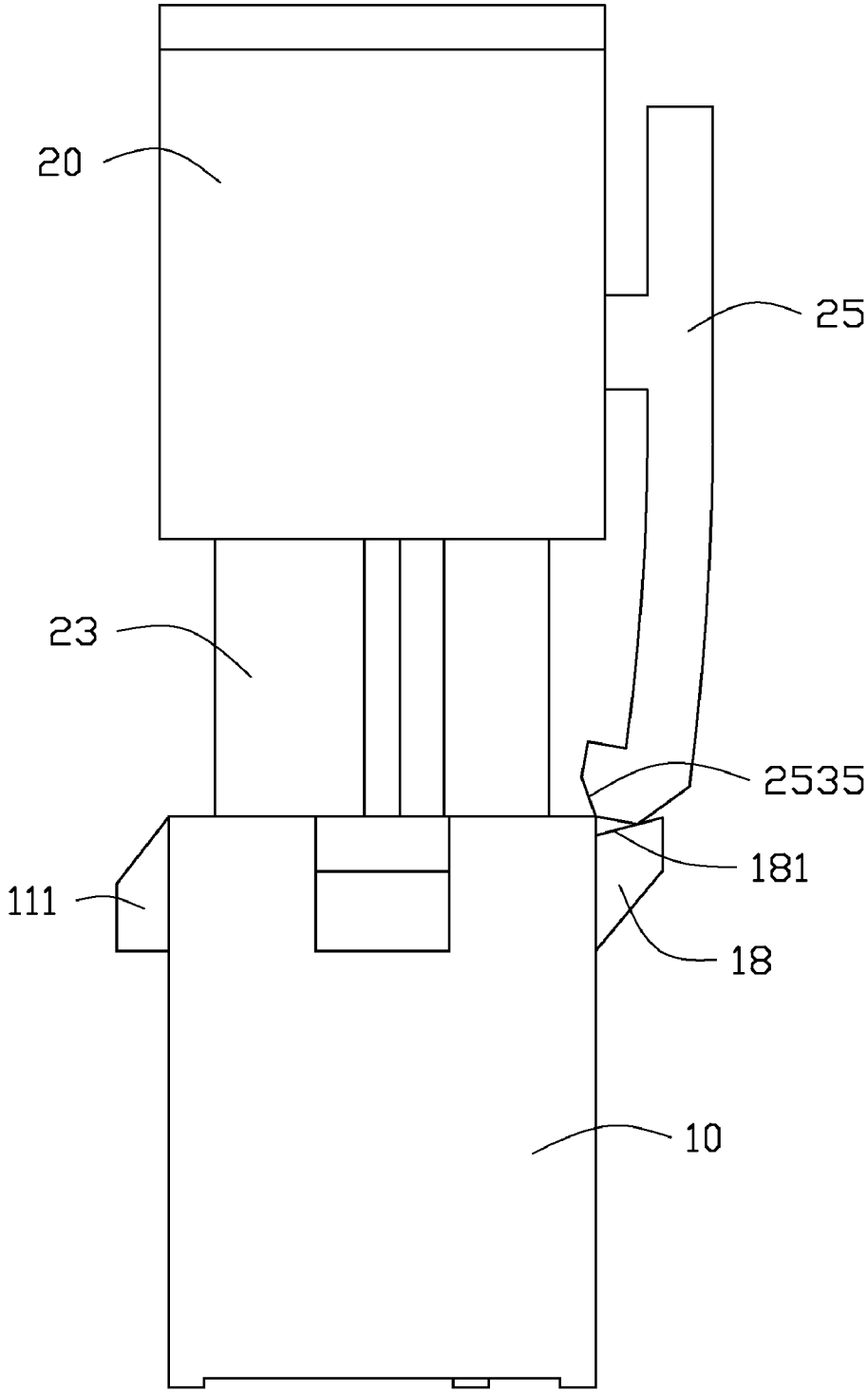
FIG. 6 is another side view of the assembled connector assembly of FIG. 1 when the connector assembly is incorrectly assembled.

FIGS. 5 and 6 show the result of any attempt to incorrectly connect the pins 23 with the slots 17. The second connector 20 is turned to align the latch 25 with one of the blocking portions 18. The second connector 20 is pushed towards the first connector 10 until the latching portion 253 abuts the blocking portion 18. The first latching plane 2533 abuts the blocking plane 181, and blocks the second connector 20 from sliding downwards. When further pressure is put on the second connector 20, the latching portion 253 is elastically deformed towards the side plate 15. The second latching plane 2535 then abuts the top edge of the side plate 15, and again blocks the second connector 20 from sliding downwards. The pins 23 are thus prevented from being inserted into the wrong inserting slots 17.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. A connector assembly comprising:

a first connector defining a plurality of inserting slots;

a positioning portion located on a first side of the first connector;

a blocking portion located on a second side of the first connector different from the first side;

a second connector comprising a plurality of pins; and a latch located on a side of the second connector;

wherein the positioning portion defines an oblique sliding plane, and the blocking portion defines an oblique blocking plane; the oblique sliding plane extends from the first side of the first connector along a first direction, the oblique blocking plane extends from the second side of the first connector along a second direction, and the first direction is opposite to the second direction; if the latch is aligned with the positioning portion and slid towards the first connector, the oblique sliding plane drives the latch to elastically deform away from the second connector and slide through the positioning portion, and the plurality of pins is insertable into the plurality of inserting slots; if the latch is aligned with the blocking portion and slid towards the first connector, the oblique blocking plane drives the latch to elastically deform towards the second connector, the latch is prevented from sliding by the blocking portion, and the plurality of pins is prevented from being inserted into the plurality of inserting slots.

2. The connector assembly of claim 1, wherein the second connector further comprises a sidewall, the latch is located on the sidewall and comprises a first latching plane, and the first latching plane abuts the oblique blocking plane when the latch is elastically deformed towards the second connector.

3. The connector assembly of claim 2, wherein the first latching plane is substantially perpendicular to the sidewall.

4. The connector assembly of claim 2, wherein the second connector further comprises a bottom wall substantially perpendicular to the sidewall, the plurality of pins is located on the bottom wall, and the latch extends out of the bottom wall and is adjacent to the plurality of pins.

5. The connector assembly of claim 1, wherein the first connector comprises a front plate and a side plate connected to the front plate, the oblique sliding plane extends obliquely from the front plate along the first direction, and the oblique blocking plane extends obliquely from the side plate along the second direction.

6. The connector assembly of claim 5, wherein the latch further comprises a second latching plane, and the second latching plane is oblique; when the latch abuts the positioning portion, the oblique direction of the second latching plane is substantially the same as the oblique direction of the oblique sliding plane.

7. The connector assembly of claim 6, wherein an acute angle is defined between the oblique direction of the second latching plane and the oblique direction of the oblique blocking plane.

8. The connector assembly of claim 6, wherein the second latching plane abuts the side plate when the latch is elastically deformed towards the second connector.

9. A connector assembly comprising:

a first connector;

a positioning portion located on a first side of the first connector;

a blocking portion located on a second side of the first connector different from the first side;

a second connector; and a latch located on a side of the second connector;

wherein the latch defines a second latching plane, and the second latching plane is oblique; the positioning portion defines an oblique sliding plane, and the blocking portion defines an oblique blocking plane; the oblique sliding plane extends from the first side of the first connector along a first direction, the oblique blocking plane extends from the second side of the first connector along a second direction, and the first direction is opposite to the second direction; if the latch is aligned with the positioning portion and slid towards the first connector, the oblique direction of the second latching plane is substantially the same as the oblique direction of the oblique sliding plane; if the latch is aligned with the blocking portion and slid towards the first connector, an acute angle is defined between the oblique direction of the second latching plane and the oblique direction of the oblique blocking plane.

10. The connector assembly of claim 9, wherein the first connector defines a plurality of inserting slots, and the second connector comprises a plurality of pins; if the latch is aligned with the positioning portion and slid towards the first connector, the oblique sliding plane drives the latch to elastically deform away from the second connector and slide through the positioning portion, and the plurality of pins is insertable into the plurality of inserting slots; if the latch is aligned with the blocking portion and slid towards the first connector, the oblique blocking plane drives the latch to elastically deform towards the second connector, and the latch is prevented from sliding by the blocking portion; and the plurality of pins is prevented from being inserted into the plurality of inserting slots.

11. The connector assembly of claim 10, wherein the second connector further comprises a sidewall and a bottom wall substantially perpendicular to the sidewall, the plurality of pins is located on the bottom wall, and the latch extends out of the bottom wall and is adjacent to the plurality of pins.

12. The connector assembly of claim 11, wherein the first connector further comprises a front plate and a side plate connected to the front plate, the oblique sliding plane extends obliquely from the front plate along the first direction, and the oblique blocking plane extends obliquely from the side plate along the second direction.

13. The connector assembly of claim 12, wherein the second latching plane abuts the side plate when the latch is elastically deformed towards the second connector.

14. The connector assembly of claim 11, wherein the latch is located on the sidewall and comprises a first latching plane, and the first latching plane abuts the oblique blocking plane when the latch is elastically deformed towards the second connector.

15. The connector assembly of claim 12, wherein the first latching plane is substantially perpendicular to the sidewall.

* * * * *